US006119410A

United States Patent [19]

Wolfe

[11] Patent Number: 6,119,410

[45] Date of Patent: Sep. 19, 2000

[54] ADJUSTABLE CONNECTOR ASSEMBLY FOR VERTICALLY COUPLING THE ADJACENT LATERAL EDGES OF CONSTRUCTION WALL PANELS

[76] Inventor: Michael J. Wolfe, 2408 Navarez Ave., Safety Harbor, Fla. 34695

[21] Appl. No.: 09/129,263

[22] Filed: Aug. 5, 1998

Related U.S. Application Data

[63] Continuation-in-part of application No. 08/908,590, Aug. 8, 1997, which is a continuation-in-part of application No. 08/695,034, Aug. 9, 1996, abandoned, and a continuation-in-part of application No. 08/695,035, Aug. 9, 1996, abandoned, and a continuation-in-part of application No. 08/695,037, Aug. 9, 1996, Pat. No. 5,901,514, and a continuation-in-part of application No. 08/695,038, Aug. 9, 1996, Pat. No. 5,826,380.

[51] Int. Cl.[7] ..... E04B 1/344

[52] U.S. Cl. ..... 52/71; 52/277; 52/588.1; 16/355

[58] Field of Search ..... 52/592.1, 588.1, 52/277, 278, 70, 71, 72, 204.66, 282.3, 282.4, 762; 16/355, 224; 160/235

[56] References Cited

U.S. PATENT DOCUMENTS

| | | | |
|---|---|---|---|
| 731,138 | 6/1903 | Stearns | 52/72 |
| 2,642,018 | 6/1953 | Weeber | 52/277 |
| 3,139,958 | 7/1964 | De Witt | 52/70 |
| 3,210,808 | 10/1965 | Creager | 52/204.705 |
| 3,893,269 | 7/1975 | Nelson et al. | 52/70 X |
| 4,438,605 | 3/1984 | DeLucia | 52/71 |
| 4,823,531 | 4/1989 | Labelle | 52/71 X |
| 4,872,297 | 10/1989 | Hetzel et al. | 52/91.1 |
| 4,934,115 | 6/1990 | Nozaki | 52/71 |
| 5,144,776 | 9/1992 | Hetzel et al. | 52/92.2 |
| 5,398,376 | 3/1995 | Pollack | 16/225 |
| 5,826,380 | 10/1998 | Wolfe | 52/71 X |

FOREIGN PATENT DOCUMENTS

| | | | |
|---|---|---|---|
| 533671 | 12/1954 | Belgium | 52/71 |
| 443930 | 3/1936 | United Kingdom . | |

*Primary Examiner*—Laura A. Callo

[57] ABSTRACT

An adjustable connector assembly for coupling the adjacent lateral edges of construction panels including an intermediate extruded plate in a generally H-shaped configuration having planar interior legs with inwardly extending projections at their ends in a generally cylindrical configuration receivable within the receptors of first and second end components and having exterior arcuate legs extending in opposite directions from the center with centers of curvature coextensive with the projections and having an intermediate coupling member extending perpendicular between centers of the first legs and second legs.

1 Claim, 14 Drawing Sheets

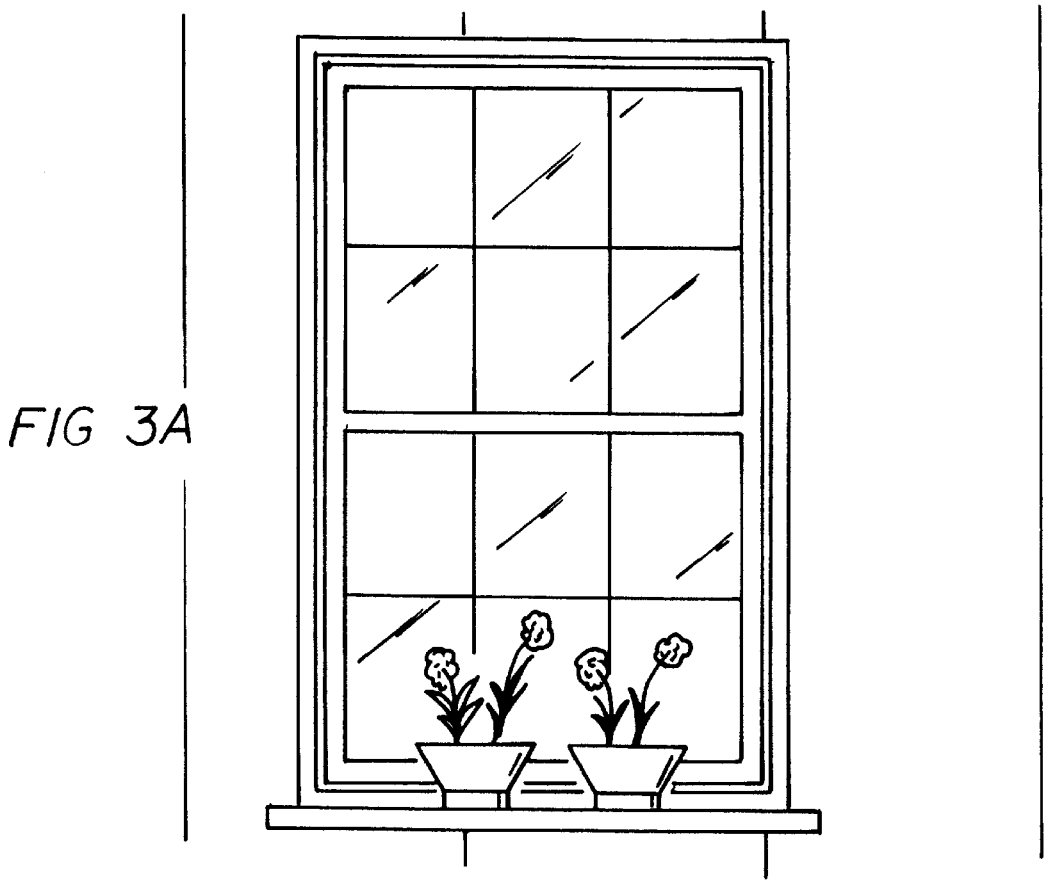
FIG 3A
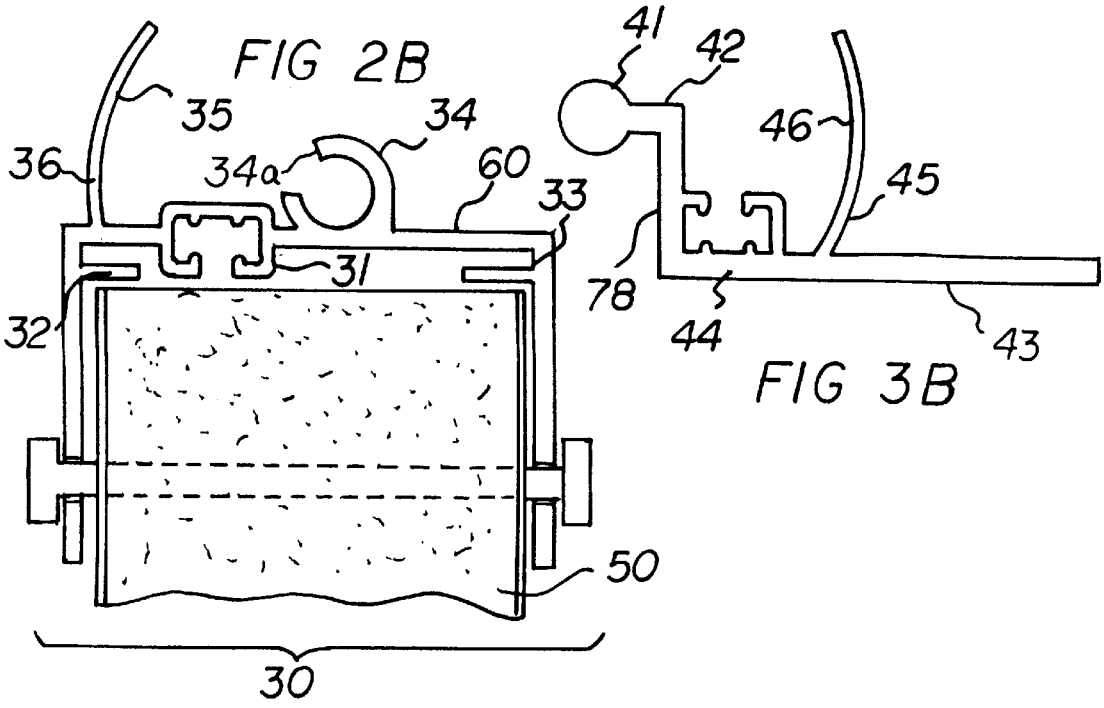
FIG 2B
FIG 3B

FIG 2C
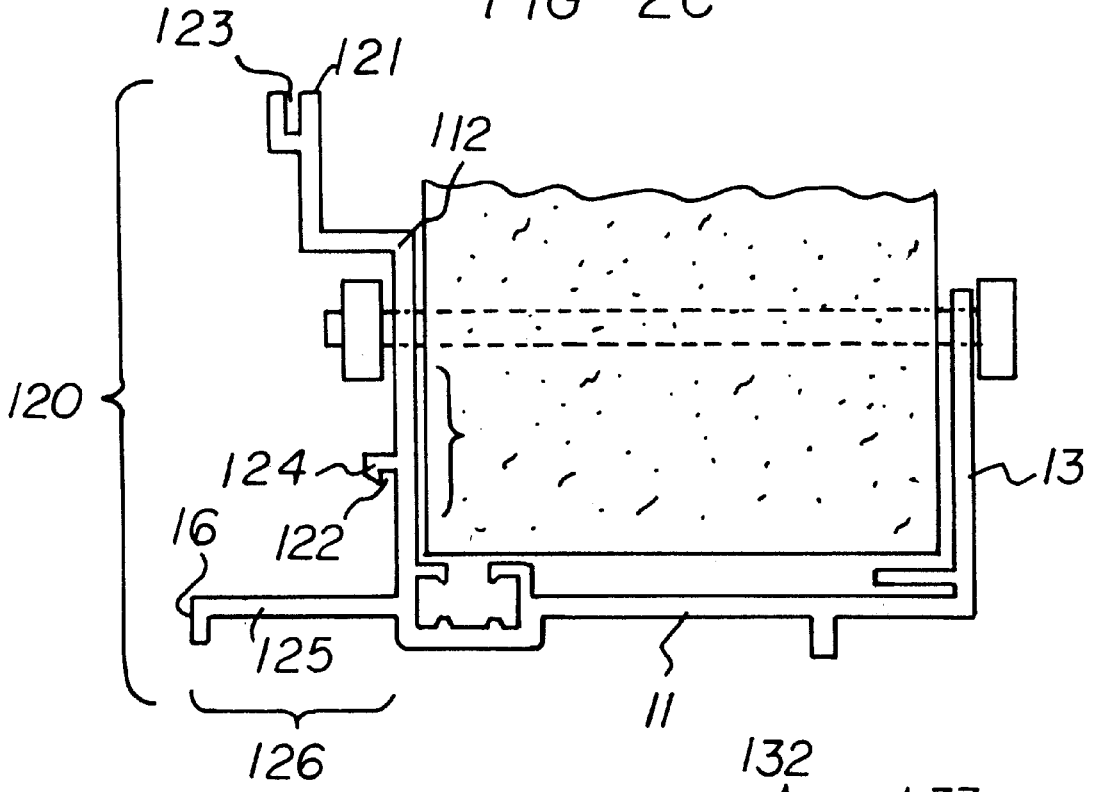
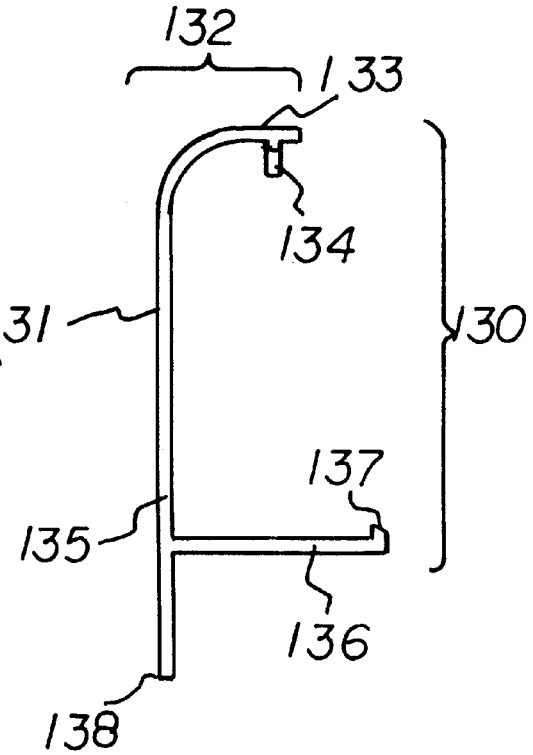
FIG 3C

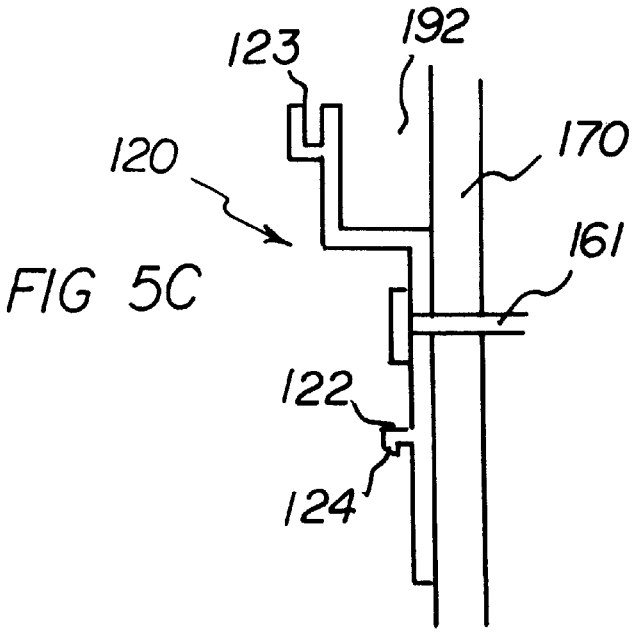
FIG 5C
FIG 6C
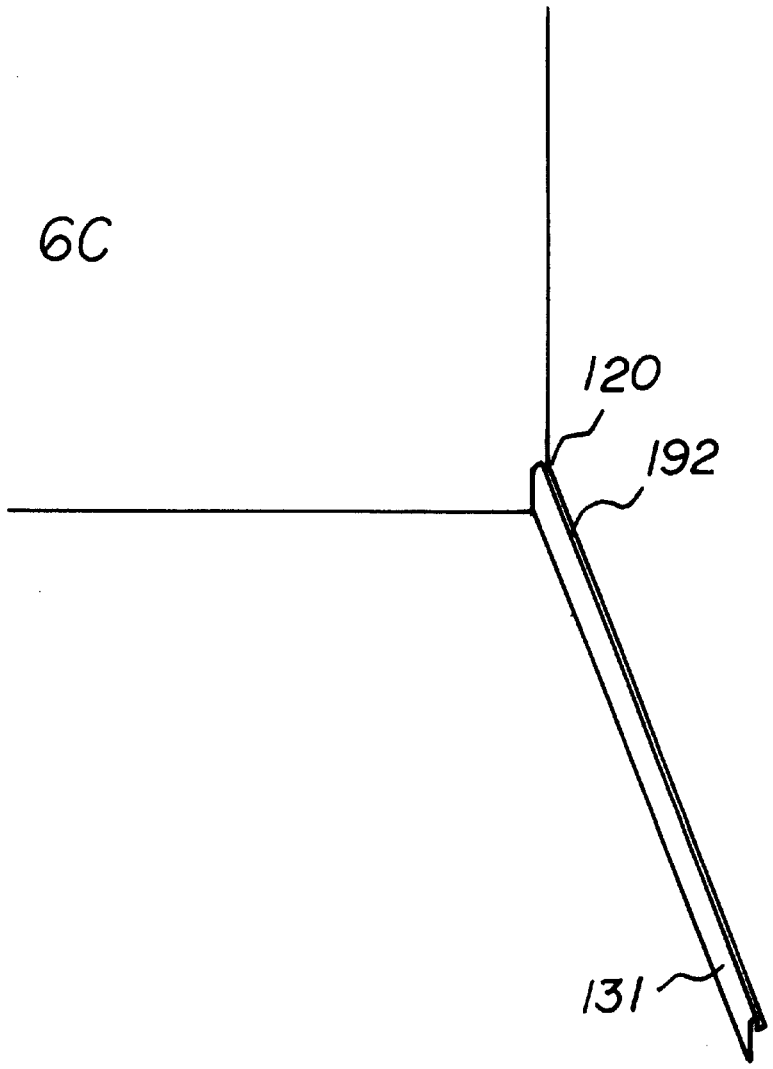

ADJUSTABLE CONNECTOR ASSEMBLY FOR VERTICALLY COUPLING THE ADJACENT LATERAL EDGES OF CONSTRUCTION WALL PANELS

CROSS-REFERENCE TO RELATED APPLICATIONS

This application is a continuation-in-part of co-pending application Ser. No. 08/908,590 filed Aug. 8, 1997, which is in turn a continuation-in-part of applications:

| Ser. No. | Filed | Status | U.S. Pat. No. |
|---|---|---|---|
| 08/695,034 | August 9, 1996 | Abandoned | |
| 08/695,035 | August 9, 1996 | Abandoned | |
| 08/695,037 | August 9, 1996 | Issued 5/11/99 | 5,901,514 |
| 08/695,038 | August 9, 1996 | Issued 10/27/98 | 5,826,380. |

The invention generally relates to building frame members which are adapted for receiving structural panels, particularly structural panels with sheet metal surfaces and elongated reinforcing steel members. Reference is made to Disclosure Document No. 399540, filed by the inventor on Jun. 25, 1996, which generally describes the enclosed invention, together with frame members adapted to receive similar panels in other building structures.

BACKGROUND OF THE INVENTION

U.S. Pat. No. 5,373,678, issued to Hesser on Dec. 20, 1994, teaches an improved structural panel in which a light-weight structural material is enclosed between two portions of sheet metal and the combination panel is further strengthened by reinforcing steel beams which are housed and enclosed within the structural panel sheets.

When uniform structural panels are used to construct all or significant portions of a building, it is useful to formulate a standardized means of framing and positioning the various structural panels. A building will only be as strong as its weakest member. Accordingly, it is important to position and frame the structural panels with framing members which are capable of securing and holding the various portions of such building or structure and will also allow the flexibility of providing a variety of building accessories or options.

Aluminum is a useful material for constructing such building frame members. Aluminum has high strength properties for structural metal applications, has a high resistance to corrosion, is easily fabricated, is reasonably light weight, can be welded or mechanically fastened together, and otherwise has properties making it acceptable as a building material.

Aluminum is also desirable for other reasons. For instance, it is easy to work with and fabricate frame members from aluminum. This is because the appropriate alloys or blends of aluminum can be produced by an extrusion process. Extruding is a very efficient and reliable way to fabricate such building components and is desirable. Materials other than aluminum may readily be utilized, as for example, plastic, fiberglass, steel, etc.

Standardization is also very helpful in this regard. There are a variety of building components which lend themselves to standardization. For instance, a typical house will have a pitched roof which extends from eave members along opposite sides through a pitched roof to a ridge top. Additionally, a building will normally have an interior baseboard. Most buildings, whether residential or commercial, will also have a need for conduits and passageways through which electrical, communications, and other wiring or cabling may be passed and will also have outside corners which may vary in angularity from 90 degrees to 45 degrees to 30 degrees, will also have varying roof designs such as gabled or hip roofs and will have gable to gable connections thereby forming valleys. Finally, most buildings will require a series of windows or other openings along exterior walls. Accordingly, it is helpful to be able to develop standardized apparatus which may be appropriate to each of these purposes.

Prefabricated, or other forms of standardized or hasty structures, require roofs just like any other. Roofs are complicated portions of the building, typically requiring substructures such as ridge beams, trusses, eaves, and roof framing beams. The pitch of a roof dictates many specific requirements of construction and also may provide important building advantages, as will be discussed in greater detail later. In the construction of such structures, it would be helpful to be able to adjust the pitch of the roof as required for a given construction situation.

U.S. Pat. No. 5,454,204, issued to Jordal, on Oct. 3, 1995, teaches a window frame which can be manufactured through an extrusion process. The window frame taught by Jordal is adapted to secure a window within a "C" frame enveloping the window components. Jordal does not, however, teach a means and apparatus for securing the window frame itself to a building comprising structural panels. The point of Jordal is in the use of thermal breaks.

What is not provided in the prior art is a simple frame apparatus which is adapted to secure a window or door frame to a building comprising structural panels. It would be useful if such a frame-mounting apparatus was also adapted with means of providing other accessories, such as a storm shutter or decorative accessories for the door or window.

U.S. Pat. No. 5,423,157, entitled "Longitudinally Assembled Roof Structure and Method For Making Same", issued to Watanabe, et al, on Jun. 13, 1995, in fact, teaches a roof which is manufactured of longitudinally aligned roof panels. Generally, Watanabe teaches roof panels which comprise interlocking sections so that such panels assemble to one another as they rise from the eaves to the roof-ridge. It can be seen that it would be both difficult and compromise the integrity of the roof panels if it were necessary to cut or sever a given roof panel. This is because it would interrupt the structural integrity of the roof panel as well as the fact that a significant coupling member would be lost by cutting off one of the sides.

Similarly, U.S. Pat. No. 4,729,202, issued to Furland, on Mar. 8, 1988, teaches another roof structure comprising pre-cut roof panels which are longitudinally disposed from eaves to roof-ridge. In the case of Furland, certain fasteners are taught. As with Watanabe, Furland deals with the means of interlocking the longitudinally disposed roof panels to one another.

U.S. Pat. No. 4,327,532, issued to Matthews, on May 4, 1982, teaches an adjustable-eave apparatus for building curtain-wall skylights and greenhouses, and other small structures, made of glass panels retained by aluminum tubes. Matthews comprises a hinged-type apparatus which would affix to each individual vertical aluminum tube so that a glass and aluminum wall could be made of adjustable pitch by aligning a series aluminum tubes with glass panels. Accordingly, the placement of each hinge would be critical. Additionally, the hinge would receive the entire stress of the weight of the sloped glass and aluminum wall. Matthews does not teach an overhanging eave.

U.S. Pat. No. 4,075,811, issued to Keith, on Nov. 11, 1976, teaches both a roof panel that is lightweight and structurally strong and also a means of fastening such a roof panel together with nut-and-bolt-type fasteners which are tightened between pairs of structural panels through a protruding-accessory design to hold the frames of the two panels in close proximity with each other and then covered with a shroud. The apparatus taught by Keith can easily be seen to interrupt the continuity of the surface of one or the other side of each pair of structural panels.

U.S. Pat. No. 4,004,373, issued to Eschbach, et al, on Jan. 25, 1977, teaches extrusions for partitions, walls, and enclosures which provide a general "C" frame. Included within the Eschbach patent are a variety of clip-on type connections, which include enclosed shrouds, which are useful in clamping and assembling such component panels of a temporary nature, such as the shell of a vehicle. The components of Eschbach are generally capable of manufacture with the extrusion process, but generally do not teach a means and apparatus of securely anchoring a more permanent type building, such as a house, to the foundation nor accommodating it with means of delivering conduit for electricity, communications lines, or other utilities.

U.S. Pat. No. 4,196,555, issued to Henges, on Apr. 8, 1980, teaches another means of linking structural panels which are of a solid-core type. Such includes interlocking frame members. In particular, Henges teaches a corner structure and a means and apparatus of pivoting or providing angled relationships between such structural panels.

The apparatus taught by Henges does not provide for any decorative aspect, nor for the area near the foundation of a wall through which conduit for electrical and communications lines may be passed.

What is not provided in the prior art is an apparatus for serving as the baseboard for an interior wall for a foundational shroud for an exterior wall for a permanent building manufactured of interlocking structural panels. It would also be helpful to have such a baseboard or foundational shroud which can be removed or clipped into place in order to install, remove, or service electrical or communications lines and to conceal and protect such lines from sight or from the elements.

What is not provided in the prior art is a roof-ridge apparatus which is uniquely adapted to receive roof panels and to permit a roof to be constructed with variable pitch so that it will not be necessary to cut or trim longitudinally disposed roof panels in order to fit the size of a given building. It would also be useful to find such an apparatus which could be manufactured through an extrusion process.

What is not provided in the prior art is an outside or inside corner apparatus which can be adjusted to connect vertical walls at different angles so that 90 degree corners and 45 degree bay window corners can be formed with the same connector.

What is not provided in the prior art is an apparatus that can connect structural panels in various roof designs such s a sloping roof connected to a vertical wall or a gable roof connected to another gable roof to form a valley. It would be useful to have such an apparatus that can be adjusted to fit the various pitches found in building roof designs.

SUMMARY OF THE INVENTION

U.S. Pat. No. 5,373,678, issued to Hesser, on Dec. 20, 1994, teaches a structural wall panel. Hesser's structural wall building panels comprise an outer and inner metal skin spaced by an intermediate insulating core of foamed polymer. Each such panel is adapted to have at least one interlocking edge with a metal lined tongue in a metal lined groove adapted to facilitate interconnection of panels as they are longitudinally interconnected. The panels taught by Hesser also comprise a reinforcing steel beam on the other side of the metal line groove. Fasteners may be passed through various portions of the interconnecting grooves and flanges in order to facilitate the connection.

While the mechanism taught by Hesser enables adjacent structural panels to interconnect, it does not teach a means of a framing the structural panels so as to specifically accommodate certain portions of a building structure, such as the roof, the eaves, the foundational frame members, and the frames for doors and windows and the outside or inside corners.

Such structural panels can be easily fabricated in mass quantities. With appropriate interconnecting members, they can be used for rapid structure of strong and reliable buildings. One of the advantages of such structural panels is in the standardization of the sizes and interconnecting members which not only make them easy to work with but also easy and quick to assemble and train construction workers for accomplishing even what would ordinarily be complicated tasks. Such standardization also facilitates the ability to standardize certain building accessories.

The Inventor has solved the problem of providing a means of fastening window frames to buildings of structural panels by providing a uniquely adapted "C" frame apparatus which can fit over either the tops or sides of such structural panels and is adapted to receive a window or door frame. Such is suitable for manufacture with the extrusion process as it of uniform cross-section throughout its entire length. The unique frame member taught herein further comprises a channel through which a storm shutter or decorative fixtures may be securely mounted about a window or door.

It is an object of the present invention to provide a means of securing window frames to a structural panel-type building.

It is a further object of the present invention to provide such a frame-mounting apparatus which may be manufactured through the extrusion process.

It is a further object of the present invention to provide such an extruded frame mounting apparatus which will further accommodate the secure positioning of storm shutters or decorative fixtures about a door or window.

Buildings constructed with the structural panels such as those taught by Hesser are assembled with the vertical edges connected together to form a continuous vertical wall assembly. The vertical walls resist windload forces transferee from the roof to the outside shear walls. These loads must then be transferred to the building foundation concrete slab or footer. These structural elements are designed to resist the positive and negative perpendicular loads and the vertical or uplift loads. It is, therefore, a necessary and important element of the building design to utilize a structural connector to attach the bottom horizontal edge of the structural wall panels to the building foundation. It would also be useful for the connector apparatus to be able to facilitate the installation of electrical wiring or communication lines within a concealed passageway.

The inventor has overcome the problems of the prior art by adapting a "C" frame member with apparatus for receiving a shroud member for concealing such electrical, communications, or other conduit or lines which may be necessary to install through a building near the floor or foundation. The assembly taught herein may easily be removed and installed by a variety of means, such as snap-ins or clip-ons.

The apparatus may be manufactured with an anchoring member which is built into the "C" frame or it may comprise a separate member for fastening onto the side of a "C" frame.

It is an object of the present invention to provide a foundational anchor which transfers the positive and negative wind loads to the building foundation.

It is, then, a further object of the present invention to provide a foundational frame member which improves the resistance of structural panel frame to both positive and negative wind load.

It is a further object of the present invention to provide a baseboard or foundational anchor shroud through which electrical or communications or other conduit may be passed.

It is a further object of the present invention to provide such a foundational shroud or baseboard shroud which can be manufactured through the extrusion process.

It is a further object of the present invention to provide such an extruded foundational shroud or baseboard shroud which may simply be installed or removed for servicing.

Perhaps the most critical portion of any roof structure is the ridge top. At the ridge top, the two sloping halves come together. It is important that the two converging halves fit precisely together so that water intrusion or air filtration will not occur. The ridge connection must be structurally strong and the beam between the halves must cause two sloping members to fit together.

It is well known that roofs are typically made with a pitch. The pitch serves multiple purposes. One purpose is to prevent the accumulation of rainwater or snow or other foreign objects on the roof in order to prevent corrosion or to prevent foreign articles from resting out of sight on the roof. Other purposes may include aesthetics or ventilation considerations. The pitch of the roof may be anywhere from a gradual or shallow angle to a steep or a sharp angle.

It should be noted that buildings constructed with structural panels such as those taught by Hesser are designed with a variety of pitches generally ranging from a 3" rise in 12" of run to a 12" rise in 12", of run. It is desirable, therefore, to have available a roof ridge member that can accommodate a variety of building designs.

The inventor has solved this problem by providing a roof ridge member with frame receiving members for receiving the edges of the structural panel members taught by Hesser and further comprise an elongated rotating sleeve member for providing a stable and reliable ridge which can adjust between a range of pitches sufficient to permit any reasonable roof pitch.

It is, then, an object of the present invention to provide a structural beam between the sloped halves of a structural panel roof that will withstand the forces of wind and other elements.

It is a further object that the ridge beam can be thermally broken.

It is, then, an object of the present invention to provide a roof framing structure for framing a roof comprising structural panels such as those taught in Hesser.

It is a further object of the present invention to teach such a roof framing apparatus which can accommodate roofs of adjustable pitch.

It is a further object of the present invention to provide a roof ridge mechanism which will work with a reasonable range of roof pitches as may be required to accommodate specific buildings.

It is a further object of the present invention to provide such a roof ridge apparatus which may be manufactured through an extrusion process.

It is a further object that the beam enables the construction of free standing rigid structures that do not need an elaborate and expensive truss system to support the roof.

It is a further object of the invention to enable the connection of the two sloping roof halves with a thru-bolt connection.

It is a further object of the invention to provide a structural connection at the panel ends which efficiently handles and manages the transfer of positive and negative windloads through the aluminum "U" channel to the foundation.

It is a further object of the invention to improve the current method of framing roof panels in order to better withstand the positive or negative windloads which may be placed upon the building foundation.

Other features and advantages of the present invention will be apparent from the following description in which the preferred embodiments have been set forth in conjunction with the accompanying drawings.

Another critical part of a building is the outside corners. Due to the high windloads exerted at this area of a building, it is necessary to utilize a structural member that can be securely anchored to the building foundation so as to hold the building corners down during severe windstorms. It would be useful that this member be adjustable to accommodate various corner angles from 30 degrees through 90 degrees.

The inventor has solved this problem by providing an outside corner member for receiving the vertical edges of a structural panel such as those taught by Hesser that completes two C-shaped receiving members connected by an elongated rotational axle member which can adjust between a range of angles sufficient to accommodate any building design.

It is then an object of the invention to provide a structural column between the two vertical walls of an outside or inside corner that will withstand hurricane strength windloads.

It is a further object of the invention that the corner connector can be thermally broken.

It is a further object of the present invention to teach a corner apparatus that can be adjusted through a range of angles.

It is a further object of the present invention to provide such a corner apparatus that can be manufactured through an extrusion process.

It is a further object of the present invention to enable the connection of the two perpendicular walls with a thru-bolt connection.

It is a further object of the present invention to provide a structural connection which efficiently handles and manages the transfer of positive and negative windloads from the outside walls to the building's foundation.

Another critical part of a building is the connection of a sloping porch roof to the outside vertical wall and the connection of a gable roof end that joins to the sloping face of another gable roof to form a valley. It would be useful that this apparatus be adjustable to accommodate the different pitches or angles found in various roof designs.

The inventor has solved the problem of facilitating the construction of roofs attached to the side of vertical walls or to the sloping half of a pitched roof by devising an apparatus to facilitate this connection that can be adjusted or rotated to fit roofs of different pitches.

It is then an object of the present invention to provide an apparatus for framing a roof comprising structural panels such as those taught by Hesser.

It is a further object of the invention to teach such a roof framing apparatus which can accommodate roofs of various pitch.

It is a further object of the invention to provide a roof ridge mechanism which will work with a reasonable range of roof pitches as may be required to accommodate specific buildings.

It is a further object of the invention to provide such a roof apparatus which may be manufactured through an extrusion process.

It is a further object of the invention to provide a connector to attach a sloping roof edge to the side of a vertical wall that does not need an elaborate and expensive truss system.

It is a further object of the invention to provide a connector to attach a sloping roof end to the face of another sloping roof to form a valley connection.

It is a further object of the invention to enable the attachment of the sloped roofs with a thru-bolt connection.

It is a further object of the invention to improve the current method of framing roof panels in order to better withstand the positive and negative windloads.

It is a further object of the invention to provide an adjustable connector that can be thermally broken.

BRIEF DESCRIPTION OF THE DRAWINGS

In describing the preferred embodiments of the invention reference will be made to the series of figures and drawings briefly describe below.

FIG. 3*a* depicts an exterior view of a window mounted within such structural panels with a fixture mounted from the accessory channel.

FIG. 2*b* depicts the wall capping frame member.

FIG. 3*b* depicts the roof panel receiving member.

FIG. 2*c* depicts the cross section of the frame anchor member for a foundational shroud member which is made integral with the foundational frame.

FIG. 3*c* depicts the cross-section of a foundational shroud member according to the present invention.

FIG. 5*c* depicts an anchor member which may be directly fastened to a building stud.

FIG. 6*c* depicts a baseboard shroud as attached to a wall.

Figure 1:
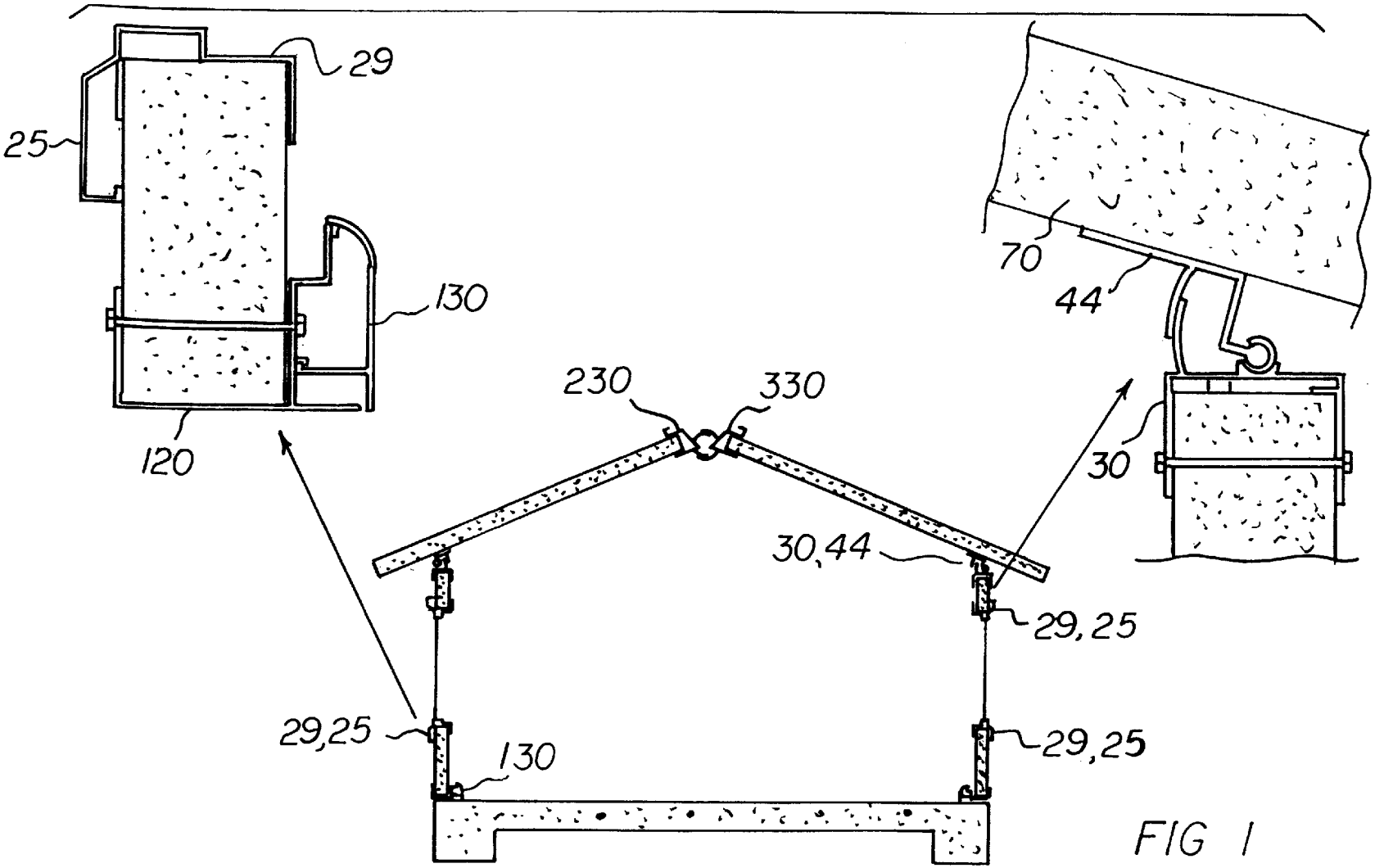
FIG. 1 is a perspective view of the preferred embodiment system for constructing manufactured homes from structural panels and joints.

While certain drawings have been provided in order to teach the principles and operation of the present invention, it should be understood that, in the detailed description which follows, reference may be made to components or apparatus which are not included in the drawings. Such components and apparatus should be considered as part of the description, even if not included in such a drawing. Likewise, the drawings may include an element, structure, or mechanism which is not described in the textual description of the invention which follows. The invention and description should also be understood to include such a mechanism, component, or element which is depicted in the drawing but not specifically described.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

While the following description will seek to improve understanding of the invention by describing the various components and elements, it should be considered that certain apparatus may be sufficiently and adequately explained by the accompanying drawings, which are fully incorporated herein, and not require further description. All such apparatus should be considered as part of the specification of the invention for all purposes.

FIG. 1 depicts the preferred embodiment of the structural connector system for the assembly of structural panel buildings. This depiction shows all of the component parts of the system utilized together. FIGS. 1*a* through 5*d* are detailed depictions of the components of the system. These components are explained in the paragraphs following the FIGS. 1 and 2 descriptions.

In its broadest context the structural connector system for the assembly of structural panel buildings comprises a plurality of connector components for coupling structural panels.

A plurality of panels are fabricated of a rigid elastomeric material with thermal insulating capabilities. Each of the panels is clad on opposite parallel faces with high gauge aluminum. The panels include roof panels with a periphery therearound and are angled with respect to each other to form a linear ridge at the top. The panels also include vertically disposed wall panels of a house with upper ends thereof positioned adjacent to the periphery of the roof panels. The wall panels also have lower edges coupled with respect to a fixed base.

A pair of adjustable roof ridge structural connectors each have a generally U-shaped side with flat faces receiving adjacent ends of the roof panels and with angular adjustable components therebetween.

An adjustable eave structural connector is positioned between the upper edges of the wall panels and the roof panels adjacent to the periphery. The eave structural connectors have generally U-shaped sides with flat faces receiving the wall panels adjacent their upper edges. The eave structural connectors have regions coupled to the roof panel with adjustment components therebetween.

Base structural connectors have generally U-shaped sides with flat faces receiving opposed exterior faces of wall panels adjacent to their lower ends. The base structural connectors include remote components fixably positionable with respect to the base.

Aperture structural connectors for windows and doors are provided. The aperture structural connectors are formed with a generally U-shaped side with flat faces receiving opposed exterior faces of wall panels at the receiving wall window and door apertures. The aperture structural connectors have second ends for receiving doors and windows, respectively.

Figure 2:
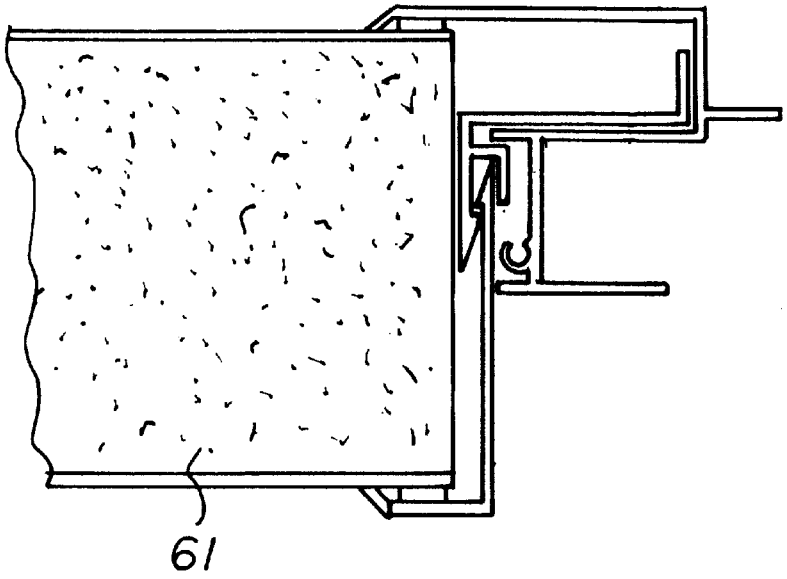
FIG. 2 is a perspective view of the Snap-Lock design window frame.

A snap-lock design window apparatus is shown in FIG. 2. Said apparatus includes a structural connector with a structural panel receiving surface and a coupling surface. The structural panel receiving surface has a through bolt coupled through it. The structural panel receiving surface also includes an anchor clip and a trim clip. The clips have interlocking heads to permit coupling of the clips The anchor clip is couplable to a window jam thereby permitting secure coupling of a structural panel to a window jam.

More specifically, the window jam has an upper region and a lower region. The upper region includes long and short horizontal segments with inboard and outboard ends. The outboard ends are connected by a vertical segment. The inboard end of the long segment is couplable to a structural panel. The lower region is formed in a generally L-shaped orientation and depends from the short horizontal segment.

The trim clip is formed in an L-shaped configuration with a short section couplable to a structural panel and a long section having a triangular head. The anchor clip has an upper vertical piece, a lower vertical piece and a horizontal piece connected therebetween. The lower vertical piece has a triangular head and a retaining member extending therefrom. In an operative orientation the upper vertical piece is coupled to the vertical segment of the window jam with a rivet and the heads of the clips are positioned in an interlocking orientation adjacent the retaining member. This orientation permits secure coupling of a structural panel to the window jam.

Figure 1A:
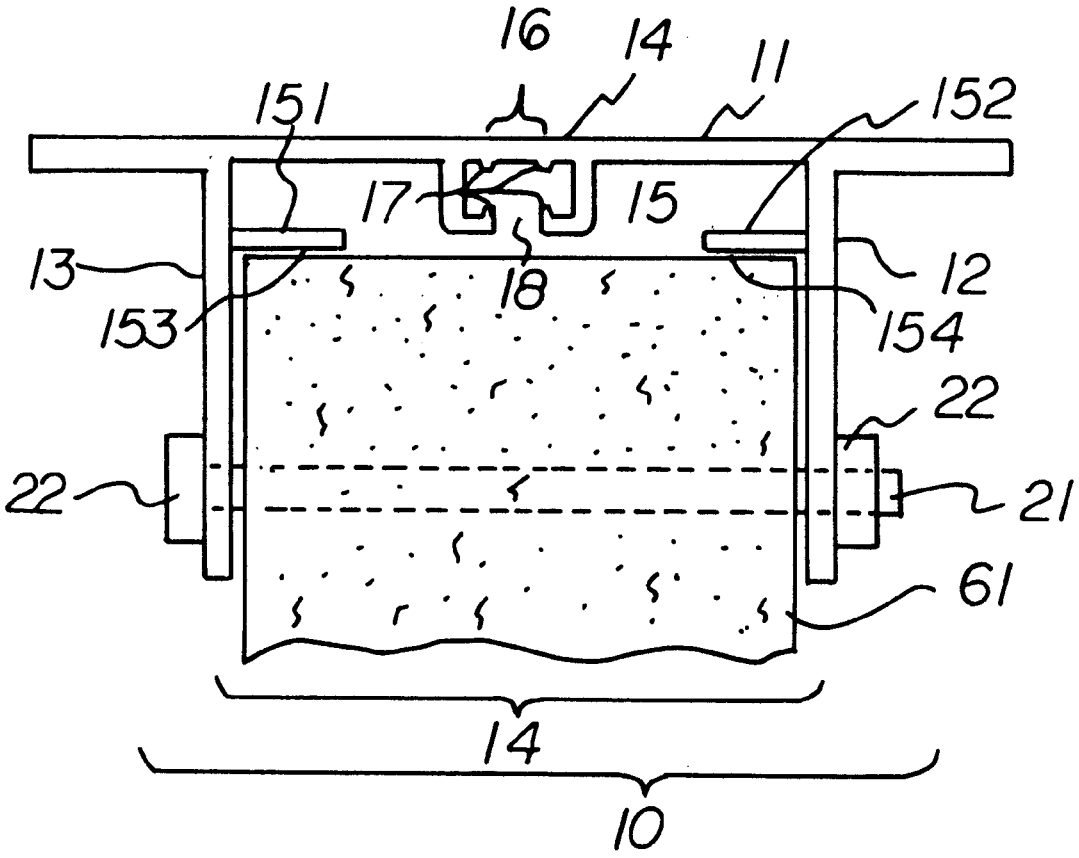
FIG. 1*a* is a cross sectional view of a standard "C" frame for receiving structural panels.

As depicted in FIG. 1*a,* a fundamental apparatus for receiving such structural panels is a three-sided frame member which generally describes a "U" or "C" (10). Such would comprise three connected flat sides (11, 12, 13) with two parallel side members (13, 12) which are joined by a perpendicular base member (11). The spacing (14) between the two side members (12, 13) would be such as to snugly receive a structural panel, such as the one taught by Hesser.

Such a general frame structure (10) may easily be manufactured with an extrusion process since all of the surfaces are both straight and uniform. In this manner such a frame member may be fabricated of any desired length and may be cut to any length. Generally speaking, in the extrusion process, an elongated apparatus with a continuous cross section can be manufactured by heating a desired metal (such as an aluminum alloy) and forcing the metal through a cross-sectional die. As the molten aluminum assumes the cross-sectional shape of the form and passes through, it begins to cool and harden. This results in an elongated metallic structure with the desired cross section and of any desired length. This is an efficient and cost-effective means of manufacturing a variety of objects, including frame members, which also produces a consistent structure. Such extrusion method is mentioned by way of general familiarization and is not claimed, in and of itself, as part of this invention. However, the potential for the utilization of extrusion in the practice of this invention is an important consideration when considering its advantages and utility.

While not necessary, as further depicted in FIG. 1*a,* it can be seen that such members may be constructed with a thermal break (15) which reduces the thermal transmission of heat or cold from the outer frame surface to the inner frame surface. This feature is particularly useful for buildings erected in cold climates. The thermal (refer to thermal break U.S. Pat. No. 3,204,324 to "Wilson") break comprises a cavity section (15) with ribbed members (17). The cavity section (15) may be filled with an adhesive binding material (18), such as a liquid urethane, while a portion (16) of the outer cavity (19) can be cut away so as to break the normal continuity in the aluminum base member (10). The structural integrity of the base member (10) through this region is now provided by the binding material (18) and a reduction in thermal transmission is achieved while maintaining the structural integrity of the "C" shaped frame (10) or the structural panel (61) which may be housed within. Such a thermal break (15) may be positioned along the length of any structural panel wall section being contained by the frame section to maintain continuity in the thermally broken and insulated building system.

It should be noted that such thermal breaks can be easily incorporated into an extrusion. It should also be noted that thermal breaks are already well known in the construction art and are not the subject of the present invention. Certain further modifications, innovations, and adaptations of frame members made with thermal breaks, however, are taught herein as means of accomplishing the objectives of the present invention. Such modifications, innovations, and adaptations are the subject of the claims of the present invention.

When a thermal break (15) is used, there is an interruption in the continuity of the base member (11). Depending upon the configuration of a given structural panel (61), this may not pose a problem. It is necessary for the structural panel (61) to rest flat and straight within the frame member (10) and the thermal break may cause a disruption of the structural panel bottom.

Additionally, such a frame member (10) is amenable to the placement of fastening screws or bolts (21) at any point along its length. Channels (22) may be drilled which pass through the frame member (10), as well as the encased or framed structural panel (61) which may receive a fastening member (21) to hold the structural panel (61) stable within or between the side panels (12, 13) of the frame member (10).

Figure 2A:
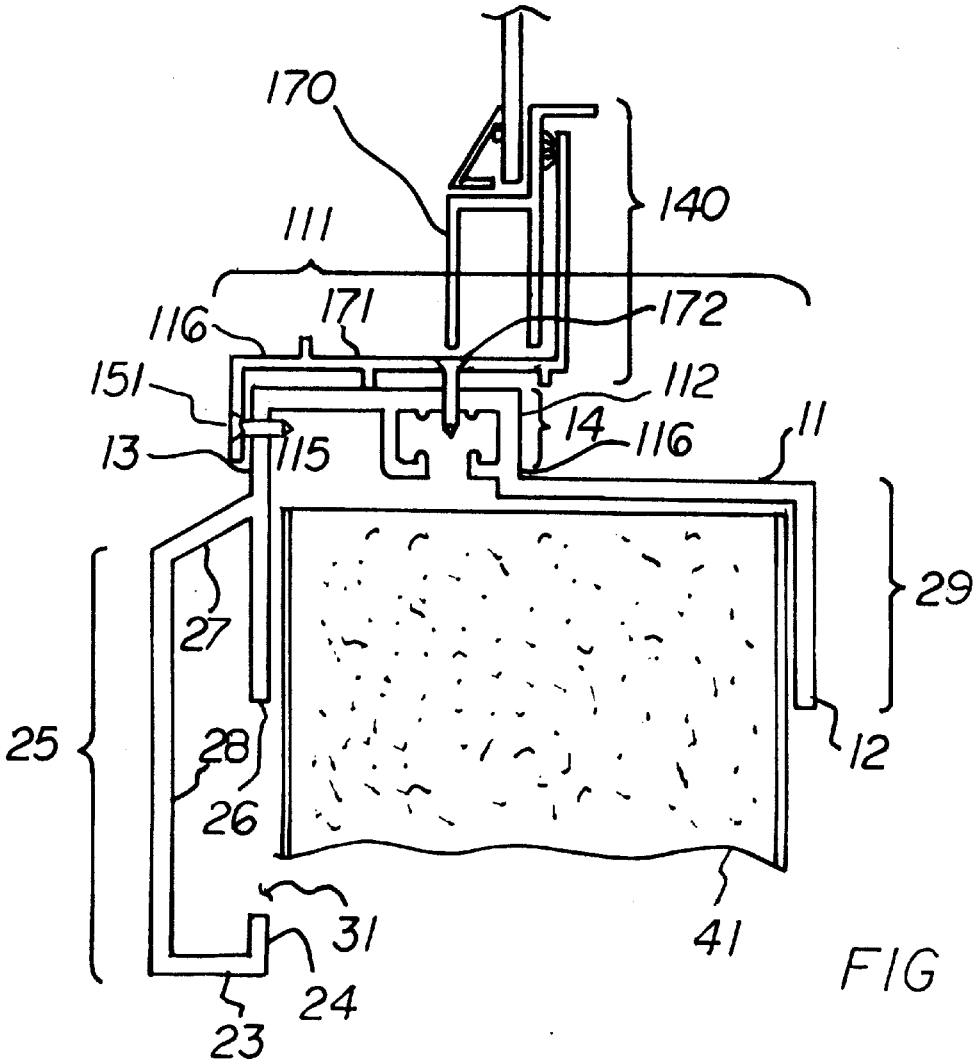
FIG. 2*a* depicts a cross section of a "C" panel which has been modified and adapted to receive a window frame.

As may be seen by reference to FIG. 2*a,* this standard "C" type structural panel frame may be modified in order to accommodate the task of anchoring a door or window frame (140) to a building comprising structural panels such as that taught in Hesser or other forms of structural panels. Such a structural panel anchor is of simplified construction and is easily tailored to work with extruded materials or to be manufactured with the extrusion process.

Making reference first to FIG. 2*a,* it can be seen that the base or interior portion (11) of a "C" frame (29) could be made with an offset portion (14). For the purpose of mounting windows and doors this "C" member would have an interior side (12) and an exterior side (13) members. However, the joining member (111) between the interior side (112) and exterior side (113) would further comprise an offset frame-receiving flange (116), which may (but need not) be used to position a thermal break (115).

Making further reference to FIG. 2*a,* it can be seen that a mounting side (171) of a window frame (170) can be fastened to the offset flange (116) by means of a fastening screw (172). It can also be seen that on the exterior side member (13) could be adapted a channeling member (25). Such channeling member (25) could comprise a generally four sided portion with straight sides (27, 28, 23, 24) and one side (25) further comprising a slotted opening (26). This slotted opening (26) would be of an appropriate dimension to receive an edge (31) protruding from the exterior surface (17) of one of the structural panels (41).

The channel defined by these sides (27, 28, 23 24) may be used to slidably receive a mount for an accessory, such as a storm shutter or a mantle for a window box of flowers. (Please see FIG. 3*a*).

Depending on whether this frame anchor member (29) was to be used for a door or a window the various surfaces on the base member and side members could be used in a variety of ways. Screw-type fasteners (151) could be driven through the window or door frame either portion of the offset or the space enclosed within the frame member adjacent to the thermal break could be used to receive an edge or protrusion upon the end of the structural panel to provide further anchoring or fastening.

Making reference now to FIG. 4*a,* it can be seen that opposite offset portions (141, 142) could be used to mount a door (180) as follows. A batt hinge (181) could be positioned on a frame corner about which a door could pivot from an open position (not depicted) to a closed position where the non-hinged door side (182) could rest against the opposite offset portion (142).

While the apparatus herein has been taught for use with a structural panel of the type of Hesser, it should be noted that such could be used with a variety of structural components, including solid-core structural panels, structural beams (such as four by four wood members commonly used for major frame portions of wooden structures), composite panels; and a variety of others. These frame members have particularly been adapted for use with the Hesser-type panels because a need existed to provide more secure and versatile framing of structural panels which included metal skins and foam interiors. The panels taught herein are of a thermal break design. It should also be noted that for thinner structural panel-type components a thermal break may not be needed. In such a case a cavity could be provided simply to accommodate a fastener or the cavity could be disposed of altogether.

Thermal breaks should not be considered a necessary part of the invention as taught herein, but have been included the descriptions and drawings in order to demonstrate that the principles of the present invention can work with frame members which may require a thermal break because of their size or other parameters.

Generally speaking, these frames may be adapted to accept panel thicknesses ranging from about two inches to ten inches. When manufactured of aluminum through the extrusion process, they may be manufactured from aluminum of high-strength alloys commonly known as 6005, 6061, or 6063.

The drawings and descriptions further have depicted some rather specific geometrical shapes for the adaptations which receive the window frame, electric conduit shroud, or other features. It can readily be seen that these specific geometrical shapes are not critical to the invention, but what is critical to the invention is that some receiving channel or area be provided to receive the desired structural component, whether it be a conduit or an edge for framing a door or a window.

Regarding FIGS. 2*b*–6*b,* note that when a thermal break (15) is used there is an interruption in the continuity of the base member (11). Depending upon the configuration of a given structural panel (61), this may not pose a problem. It is necessary for the structural panel (61) to rest flat and straight within the frame member (10) and the thermal break may cause a disruption of the structural panel bottom. There may also be situations wherein it is necessary to position a structural frame (10) more precisely within the frame (10) and apart from the base member (11). In these cases one or two positioning platforms (151, 152) could be positioned and inwardly disposed from either side member (12, 13) of the frame (10). Such positioning platforms (151, 152) would have planar surfaces (153, 154) which were perpendicular from the side members (12, 13). If two positioning platforms were to be used, they should line up within the same plane. It can be seen that such positioning platforms (151, 152) could easily be included in an extrusion form.

Additionally, such a frame member (10) is amenable to the placement of fastening screws or bolts (21) at any point along its length. Channels (22) may be drilled which pass through the frame member (10), as well as the encased or framed structural panel (61) which may receive a fastening member (21) to hold the structural panel (20) stable within or between the side panels (12, 13) of the frame member (10).

Making reference now to FIGS. 2*b* and 3*b* a capping member (30) for the upright wall is depicted. It can be seen that the capping member (30) is basically a "C" joint which may, but need not have, an offset thermal break (31) and which further may include one or two interior protrusions (32, 33) for enabling the capping member (30) to stably rest upon the top of a structural panel (50) without being compromised or disturbed by the thermal break (31).

Still making reference to FIG. 2*b* it can be seen that upon the exterior top (60) of the capping member (30) is provided a rotational sleeve (34) and an arched flange (35) which has one surface (36) of an appropriate arc and length to congruently slide along the surface (46) of the roof receiving flange (45). The rotational sleeve further comprises an elongated slot opening (38), which is large enough to accommodate an offset portion as will be described later.

Making reference now to FIG. 3*b* the construction of the roof receiving member will be more thoroughly described. An elongated rotational axle (41) is at the end of a shank member which may further be connected in an offset manner by an offset connector (78) to a roof receiving surface (43). A thermal break coupling (44) may, but need not, be provided for reducing thermal transmission. A flange (45)

with at least one circularly arced surface (46) is adapted on the lower side of the roof receiving surface (43) for the purpose of providing rotational stability as will be described later.

Figure 4D:
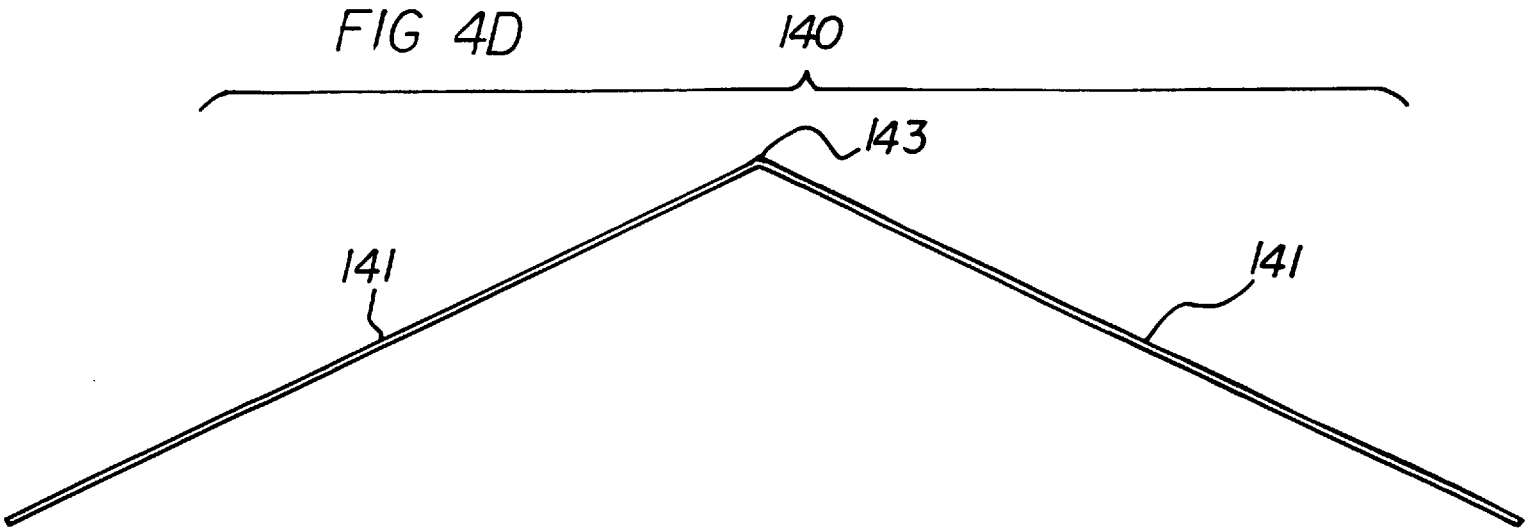
FIG. 4*d* depicts the cross-section of a roof ridge shroud member.
Figure 4A:
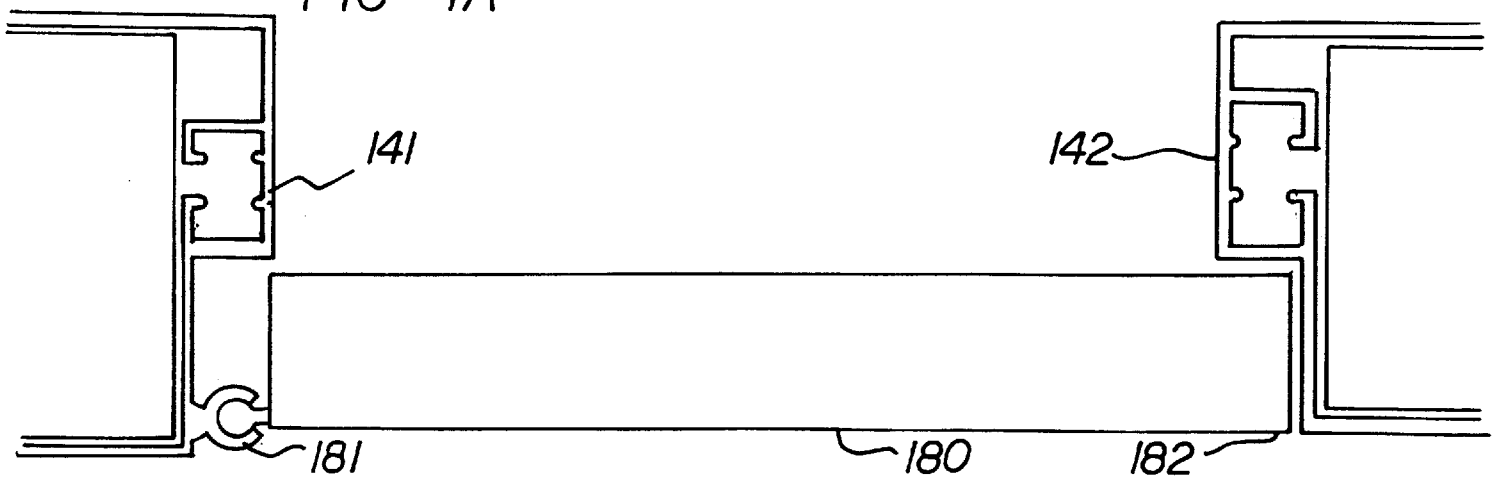
FIG. 4*a* depicts a cross-sectional view of a door positioned and framed by framing members according to the present invention.
Figure 4B:
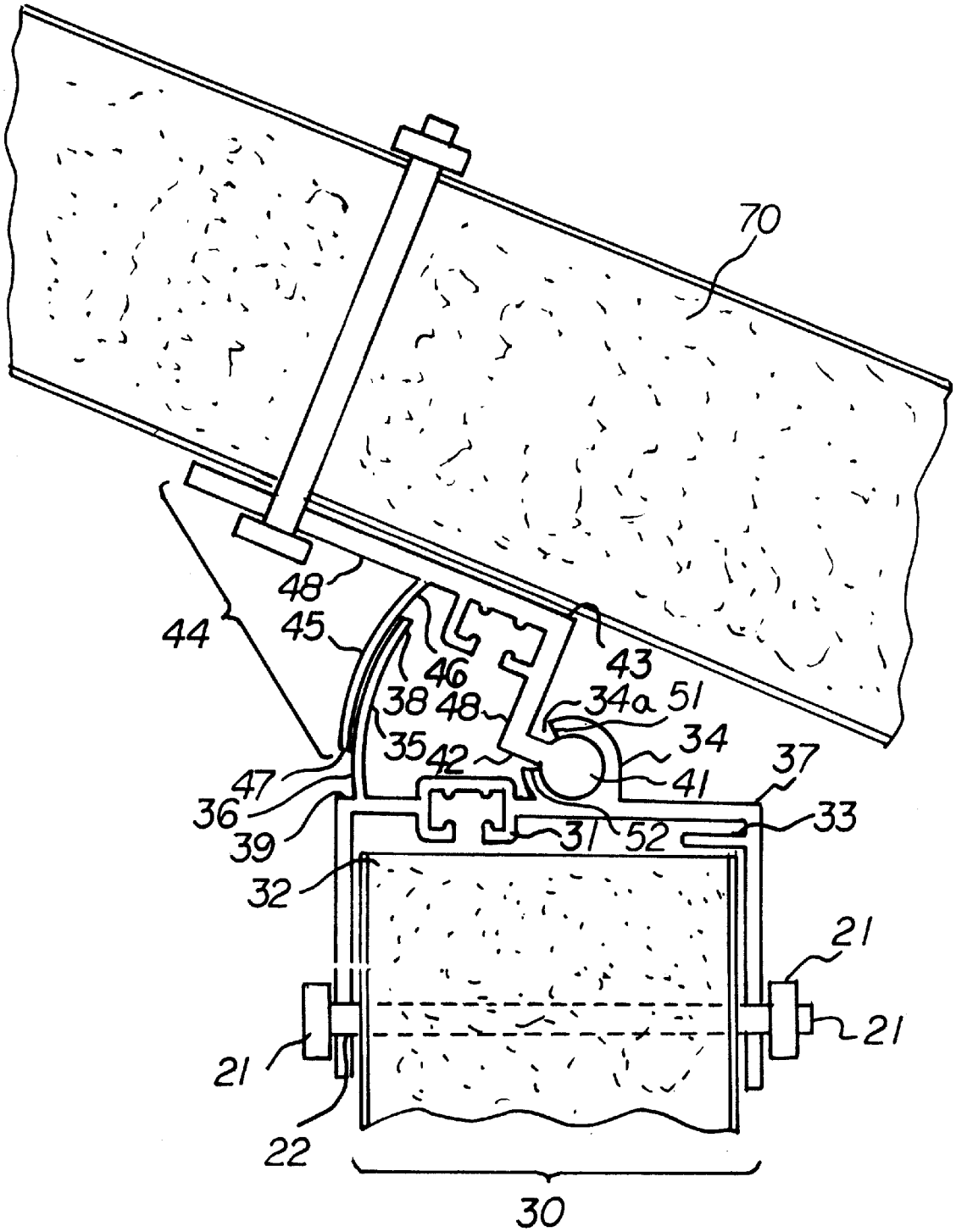
FIG. 4*b* depicts the eave mounting apparatus as assembled.

Making reference now to FIG. 4*b* it can be seen how the pieces fit together. The length of the elongated rotational axle (41) may be slid through the length of the rotational sleeve (34). The elongated rotational axle (41) should be of a size to snugly fit within the rotational sleeve (34) but not so tight as to prevent free rotation throughout the permitted range of rotation, which can be seen to be defined by the rotation of the shank (42) through the sleeve slotted opening (34a).

The permitted range of rotation can be seen to be that range which will permit an overhanging roof member (70) from making contact with the outer corner (37) of the capping frame member (30) as the steepest pitch allowed and then rotating to a point where the ends (38, 47) of the two flange members (34,45) make contact with either or both the lower portion (48) of the roof receiving surface (43) or the exterior top (39) of the capping member (30), respectively.

To further complement the stability and operation of the apparatus the various movable portions may be precision engineered to precisely define this range. For instance, each of the arched flange members (35, 45) could be cut to an arc and length so that the ends (38, 47) of the flange members (35, 45) will touch the respective surfaces (48,39) of the other cooperating member (30, 43) precisely at the point of the smallest pitch angle and that an overhanging roof panel (70) sitting on top of the roof receiving surface (43) will approach the outer corner (37) of the capping frame member (30) at or near the steepest allowable roof pitch. In a similar manner, the shank (42) of the elongated rotational axle (41) may also be adapted or configured to make contact with the upper (51) and lower (52) lips of the opening (34a) of the rotational sleeve (34) at the same maximum and minimum roof pitch angles.

It should also be noted that the arched flange members (35, 45) are adapted with a locking means. In the preferred embodiment such locking means comprise a self threading screw positioned through a pilot hole drilled through the flanges. In alternate embodiments a bolt may be passed through a hole drilled in capping member flange (35) and a corresponding hole in the platform flange (45) in order to provide increased stability.

Figure 6B:
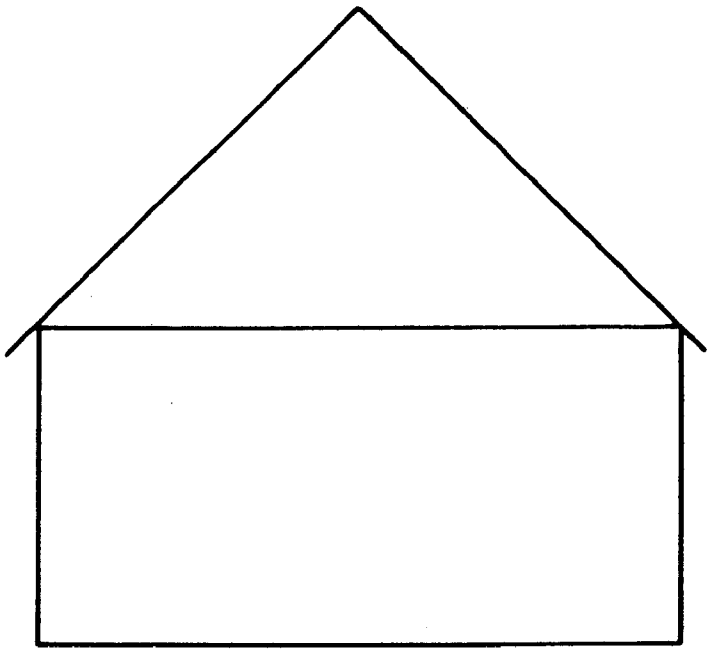
FIGS. 5*b* and 6*b* depict roofs of varying pitch.
Figure 5B:
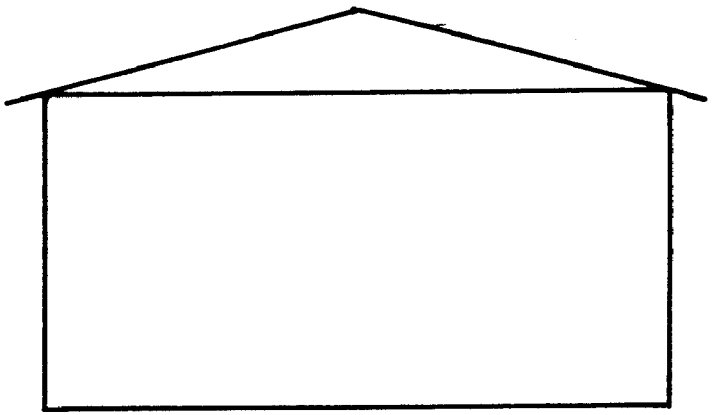

Of course, it should also be seen that these maximum and minimum pitch angles could be selected to correspond with angles appropriate for use with two or more panels on a given 10 roof side. For instance, if a given roof panel were to be 13 feet wide and a 2 foot overhang were desired, if can be seen that two structural panels of 8 feet length would be sufficient to cover the roof and would have a roof pitch of 12 feet of run, and just over 7 feet of rise. If, however, the desired roof side were 17 feet with 2 feet of overhang, then three panels would be needed and the roof pitch would be 15 feet of run and 16 feet rise, which is much stronger. FIGS. 5B and 6B depict two roofs of varying pitch, but which comprise the same roof member components, particularly referring to the respective eave assemblies.

While the apparatus herein has been taught for use with a structural panel of the type of Hesser, it should be noted that such could be used with a variety of structural components, including solid-core structural panels, structural beams (such as four by four wood members commonly used for major frame portions of wooden structures), composite panels; and a variety of others. These frame members have particularly been adapted for use with the Hesser-type panels because a need existed to provide more secure and versatile framing of structural panels which included metal skins and foam interiors. The panels taught herein have thermal breaks. It should also be noted that for non-thermally broken systems a thermal break may not be needed. In such a case the thermal break cavity would not be filled and debrided or the cavity could be disposed of altogether.

Thermal breaks should not be considered a necessary part of the invention as taught herein, but have been included in the descriptions and drawings in order to demonstrate that the principles of the present invention can work with building systems which may require a thermal break.

It should be noted that the invention has been discussed with respect to structural panels of the type taught by Hesser. It should-be noted that the features and principles of the present invention could also be used or successfully practiced with a variety of other forms of structural panels. It is anticipated that any structural panel which would be used by this invention would be such as to permit the boring of a hole for the purpose of receiving bolt-type fasteners through the opposite sides of the variously configured "C" frame members. However, even that could be subject to substitution by other forms of adhesive or fastening members which could be passed through or affixed upon to bind the "C" frame to a desired structural panel.

Generally speaking, these frames may be adapted to accept panel thicknesses ranging from about two inches to ten inches. When manufactured of aluminum through the extrusion process, they may be manufactured from aluminum of high-strength alloys commonly known as 6005, 6061, or 6063.

The drawings and descriptions further have depicted some rather specific geometrical shapes for the adaptations which receive the window frame, electric conduit cover, or other features. It can readily be seen that these specific geometrical shapes are not critical to the invention, but what is critical to the invention is that some receiving channel or area be provided to receive the desired structural component, whether it be a conduit or an edge for framing a door or a window.

As depicted in FIG. 2*c,* such a "C" frame member may be adapted on either the interior or exterior side with a base plate or baseboard anchor member (120) for receiving and passing electrical, communication or other conduit. As depicted in FIG. 2*c,* one of the side panels (12, 13) could be adapted with an offset portion (121) and a snap-in portion (122). The offset portion (121) is adapted with an elongated slot (123). The snap-in portion (122) is adapted with a slanted lower surface (124). The lower or base frame section (125) is extended beyond at least one of the upright sides (12, 13) with an extended length (126).

It can be seen how a shrouding member (130) (please see FIG. 3*c*) can be adapted to snugly and securely fit upon the anchor member (120) in order to provide an acceptable and decorative shroud (131) for electrical, communications, or other conduit not depicted). Such shroud (131) would have an upper portion (132) which ends in a generally flat top portion (133) which is adapted with a elongated and flat protrusion (134). This elongated and flat protrusion (134) is adapted to snugly fit within the elongated slot (123) on the offset portion (121) of the anchor member (120). From the generally flat-top portion (133) may extend a shroud cover (131) which, as depicted in FIG. 2*c,* arcs around to a shroud side (135) which may, but need not be, parallel to a side (127) of the anchor member (120) and generally perpendicular to the flat top portion (133) of the shroud member (130).

While the drawing depicts an arcing shroud member (130), it should be noted that the convergence between the flat top (133) and side (135) of the shroud member (130) could be achieved by having right-angle portions, an angled member from the top portion down to the desired point and/or other similar configurations. Such alternative configurations can easily be understood or conceptualized from this description and are not separately depicted in drawings.

From the shroud side (135) extends an elongated snap-in member (136) which is adapted to cooperate with the anchor member snap receiving portion (122) as follows. The shroud member snap-in portion is adapted with an upper surface which matches the snap-in surface of the base-receiving member. The shroud snap-in member (136) can then be pushed against the anchor snap receiving member (122). The shroud elongated protrusion (137) upon which the snap-in member (136) is fixed may then give sufficiently with the stress of being pushed in to the anchor enabling the shroud snap-in member (136) to pass over the slanted surface (124) of the anchor snap-in portion (122) until it passes it and snaps into place between the anchor member (122) and the snap-receiving member (122).

Figure 4C:
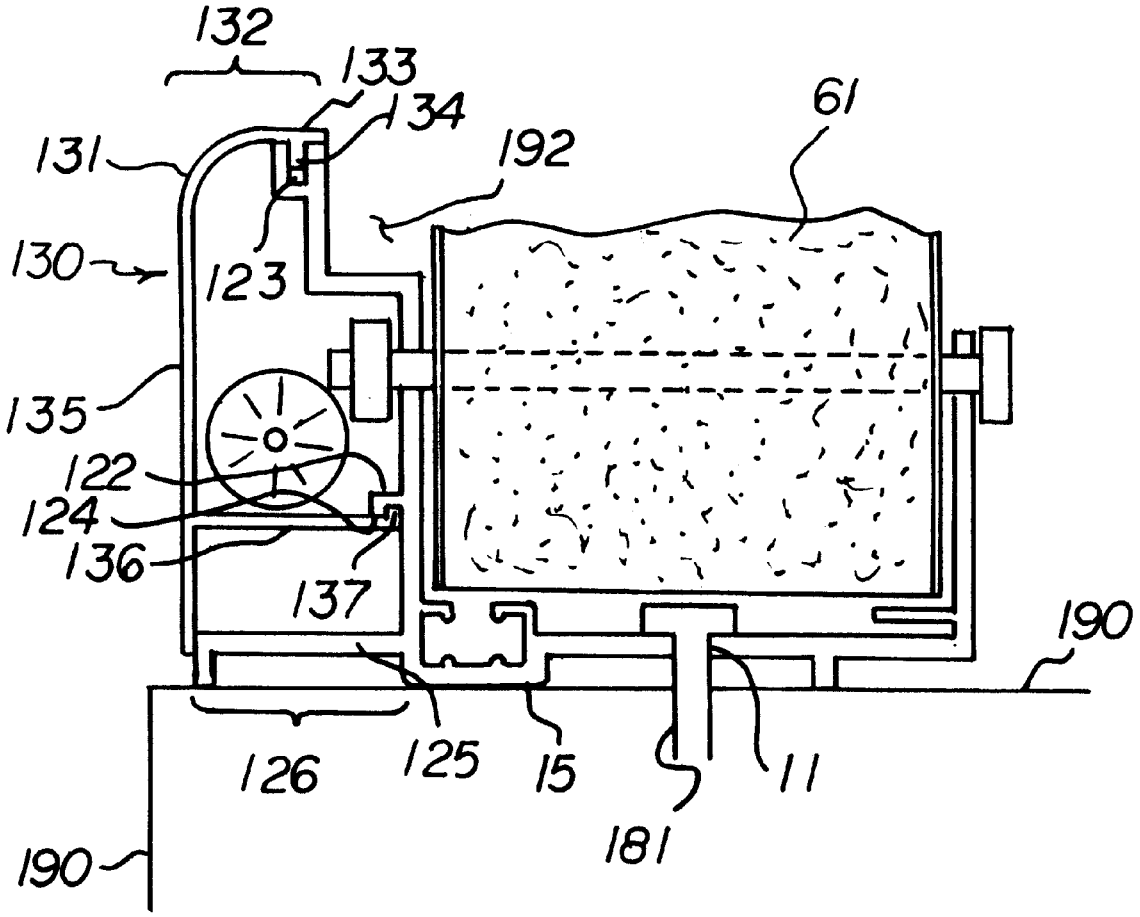
FIG. 4*c* depicts the anchor and shroud members as interconnected.

The side (135) of the shroud member (130) extends generally down to a point (138) at which it can match up with the elongated end (16) of the base member (11) or, if there is no elongated end to the base member (11), it can be cut or broken to an appropriate length to match up with a floor or other surface (not depicted) FIG. 4*c* depicts the apparatus as assembled with the cooperating parts in place.

Making reference to FIG. 5*c,* it can be seen that the anchor member for receiving the shroud could be a separate piece bolted onto a building stud (170) rather than built into a structural panel frame as described in FIG. 2*c.* As a fastener (161) will normally be used to hold structural panel (61) into place, the same fastener (161) could be used to hold a shroud receiving apparatus onto a desired stud member (170). In either case the shroud member would function in the same way.

The basic structure of the shroud-receiving member could be accomplished in a number of ways and with a variety of alternative structures which do not deviate from the basic components, which include an elongated slot and snap-receiving member on the base shroud receiving member and an elongated edge and snap-in member on the shroud member.

It should also be noted that the thermal break in this base anchor is not at the center of the base of the "U" member. This enables this thermal expansion to be closer to the center of the full length of the base member. In order to ensure an appropriate leveling of the fastened structural panel, it can be seen that from the interior side of the opposite side member is provided a ledge upon which the outer skin of the structural panel may rest in order to be level with the opposite thermal expansion side.

The baseplate anchor depicted in FIG. 2*c* is suitable for use along the foundation of an exterior wall. The structure depicted in FIG. 3*c* is more suitable for use on the baseboard of an interior wall. In either case, however, the general structure is the same and the function is the same, namely to provide a continuous and attractive surface which can be used to shroud the desired electrical, communications, or other conduit. It should be noted that the lower portion of the base member of the exterior wall baseplate anchor may further be adapted with means of leveling it with the thermal expansion or providing a better fit along the outside of a foundation.

It is also possible to replace or substitute another fastening means for the snap-in members presently taught at the bottom of the shroud. For instance, the lower end of the shroud and the lower end of the anchor member could be adapted with some combination of cooperating slot and edge members to allow the shroud to be slid into position along the lower foundational frame anchor. This would be somewhat less convenient, but would be more stable. Moreover, such a double slot combination could most likely be used only with exterior walls. It should be noted that the lower slot and edge could be reversed so that the edge could be positioned upon the lower portion of either the anchoring member or the lower interior portion of the shroud member and cooperate with a slot positioned on the facing side of the other member.

Additionally, the anchor or shroud members could have a lower protruding positioning edge of sufficient width to just hold the shroud in place by gravity. Such an apparatus could be given additional stability by simply driving a long screw through the shroud which may extend and be turned into the anchor member as well.

Making reference again to FIG. 4*c,* two important modifications of the apparatus should be discussed. First is that, when the foundational member is being used as a true foundation, one or more foundational anchor bolts (181) could be used in order to secure the frame and the wall to the building foundation (190). This would almost always be the case when the present invention is used on the ground floor of a structure and could also be used for upper floors, if desired. Additionally, the various forms of the anchor shroud apparatus taught here have included an upper pocket (192), which is created by positioning the upper slot (123) away from the structural panel (61). This pocket (192) may be used to receive drywall or other wall coverings as desired (See FIG. 6*c*). It would, however, be possible to practice the present invention with no such pocket. In that case, the entire anchor shroud would rest flush against the structural panel. This need not be depicted herein, but should be understood as an alternative which is in keeping within the spirit and scope of the present invention.

Figures 2D, 3D:
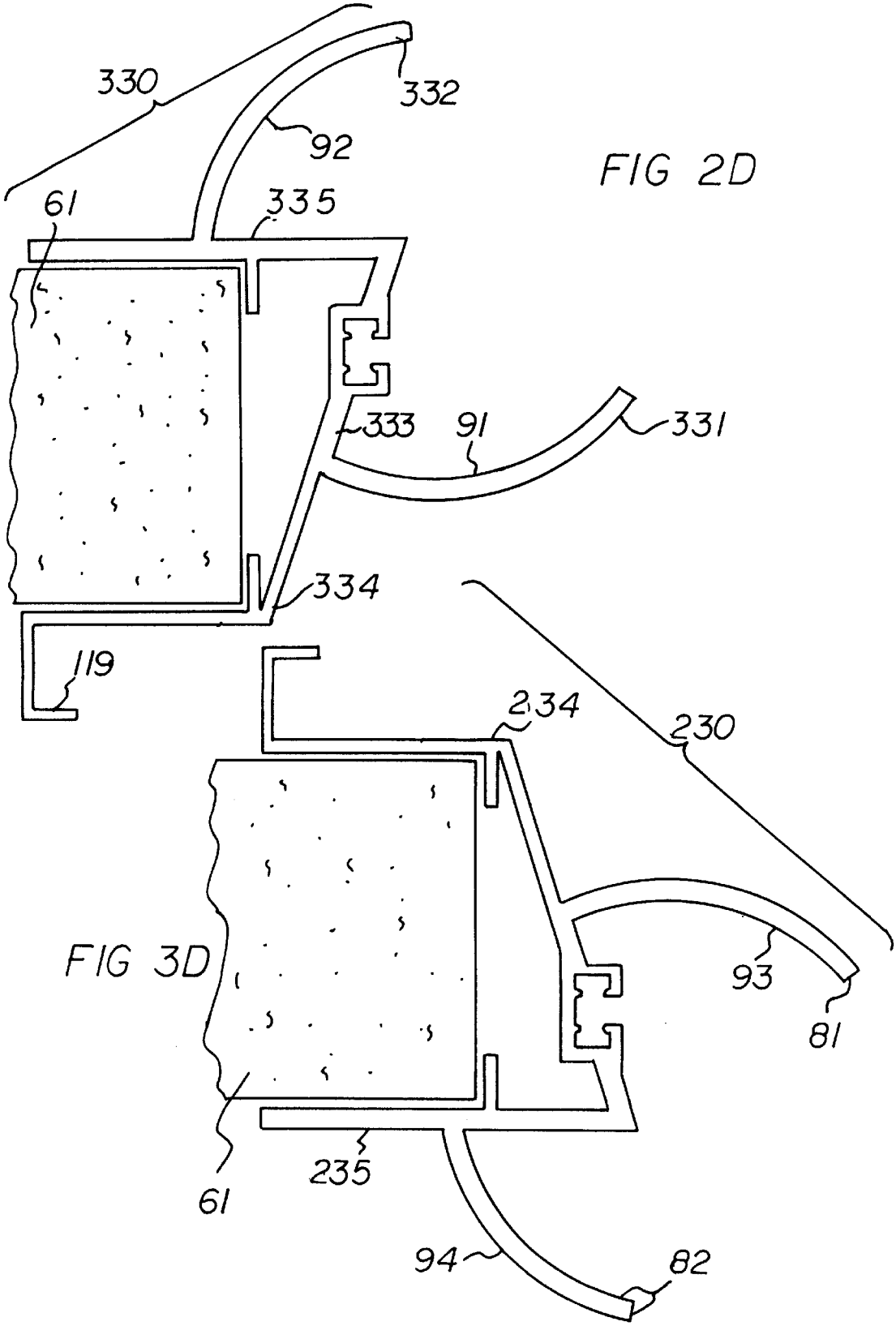
FIG. 2*d* depicts a cross-section of a roof ridge member according to the present invention with an outer sleeve member.
FIG. 3*d* depicts a cross-section of a roof ridge member with an inner rotating axle member.

Making reference now to FIG. 2*d* it can be seen that the basic frame member structure has been substantially modified to form a first roof top frame member (110) in order to receive the top edge of a structural roof panel member (61) in a frame (330) which is further adapted with arched flanges (331, 332) which arc out from the base portion (333) and lower side member (335) so as to have outer surfaces (91, 92) which geometrically define two portions of the same circle. Additionally, the base portion (333) of the frame member (330) is angled slightly from the upper side member (334) to the lower side member (335). The importance of this will be discussed later. The top of this frame side further comprises a fixture (119) for receiving a roof top shroud.

Making reference now to FIG. 3*d* it can be seen that this same modified basic frame member structure has been substantially reproduced in order to form a second roof top frame member (120) in order to receive the top edge of a structural roof panel member (61) in a frame (230) which is further adapted with inner arched flanges (81, 82) which arc out from the base portion (233) and lower side member (235) so as to have outer surfaces (93, 94) which geometrically define two portions of the same circle. The circle defined by these flanges (81, 82) is of a dimension to snugly fit and rotate within the circling flanges (231, 232) of the first roof top frame (110) frame. Additionally, the base portion (233) of the frame member (230) is angled slightly from the upper side member (234) to the lower side member (235). The importance of this will be discussed later. The top of this frame side further comprises a fixture (129) for receiving a roof top shroud.

FIG. 4*d* depicts the cross-section of a roof ridge top shroud member (140). Such ridge top shroud member (140) comprises two ends (141, 141) which are joined at an apex (143) in order to form a triangle shape. The ends are further adapted with fixtures (144, 145) which are adapted to be fastened and housed within receiving members on each of the first and second roof top frame members (119, 129).

Figure 5D:
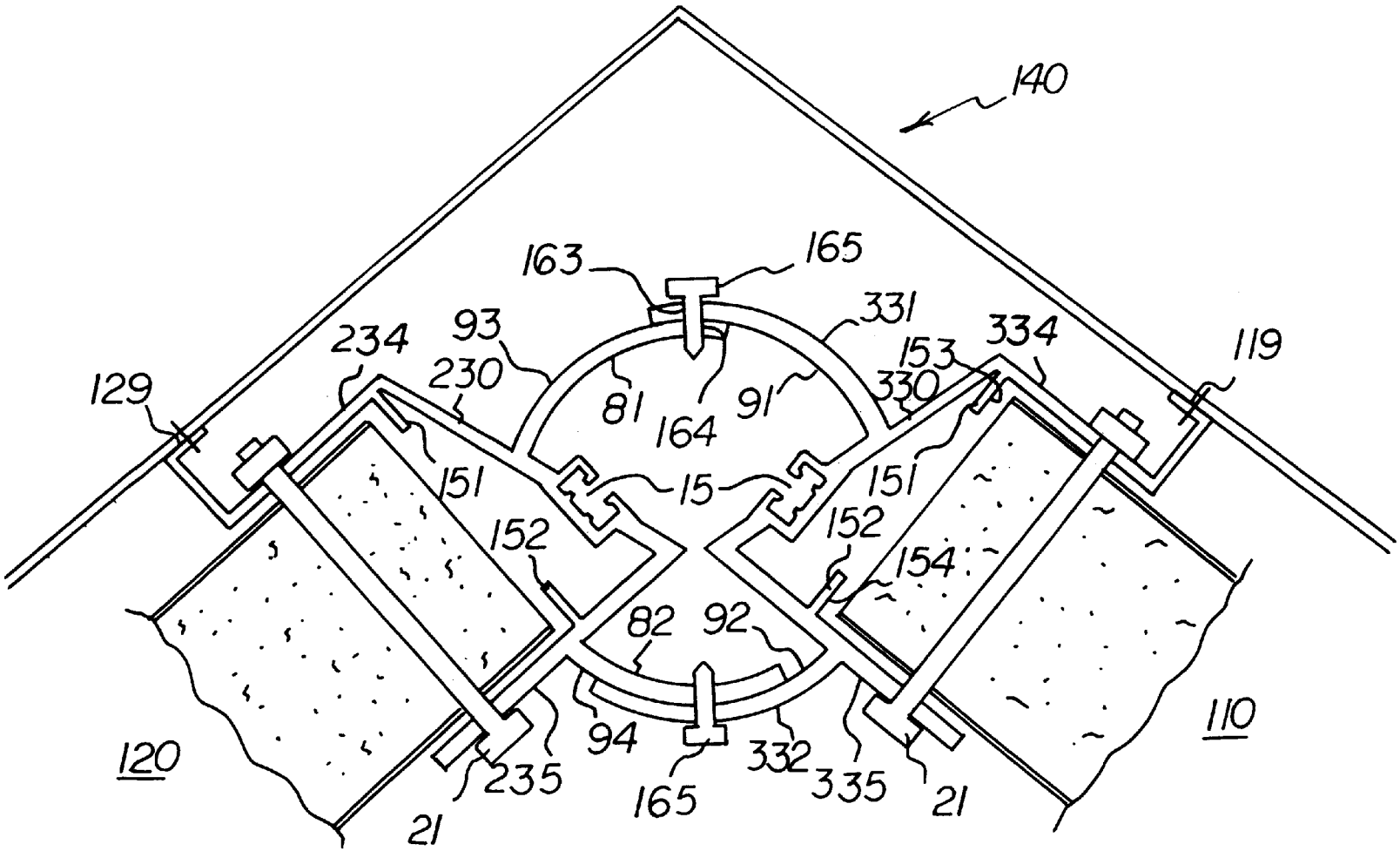
FIG. 5*d* depicts the cross section of all pieces of the ridge apparatus assembled.

Making reference to FIG. 5*d,* which is the cross section of an assembled roof ridge apparatus, it can be seen that the outer arch flanges (331, 332) and the inner arch flanges (81, 82) are adapted to rotate about one another within a reasonable range of rotation. The above-described angled base members (230, 330) facilitate this relationship by allowing greater angles through which the rotation may occur.

Making further reference to FIG. 5*d,* it can be seen that locking means are applied to the cooperating pairs of flanges (331, 81), or (332, 82). In the preferred embodiment such locking means comprise a self-threading screw (165) positioned through a pilot hole drilled through the outer and inner flanges. In alternate embodiments a bolt could be passed through a hole drilled in the outer flange (331) and a corresponding hole drilled in an inner flange (81). Said locking means are utilized for both flange pairs and spaced at eighteen inch intervals.

It may now be seen that the cooperating roof ridge frame members rotate about one another so as to accommodate a wide range of pitches for the roof. Of course, it should also be seen that these maximum and minimum pitch angles could be selected to fall within the range of pitches from 3:12 to 12:12, which are generally the minimum and maximum acceptable pitches used with standard roof construction. FIGS. 5*b* and 6*b* depict two roofs of varying pitch, but which comprise the same roof member components, particularly referring to the respective roof ridge assembly components and roof panels.

Figure 7:
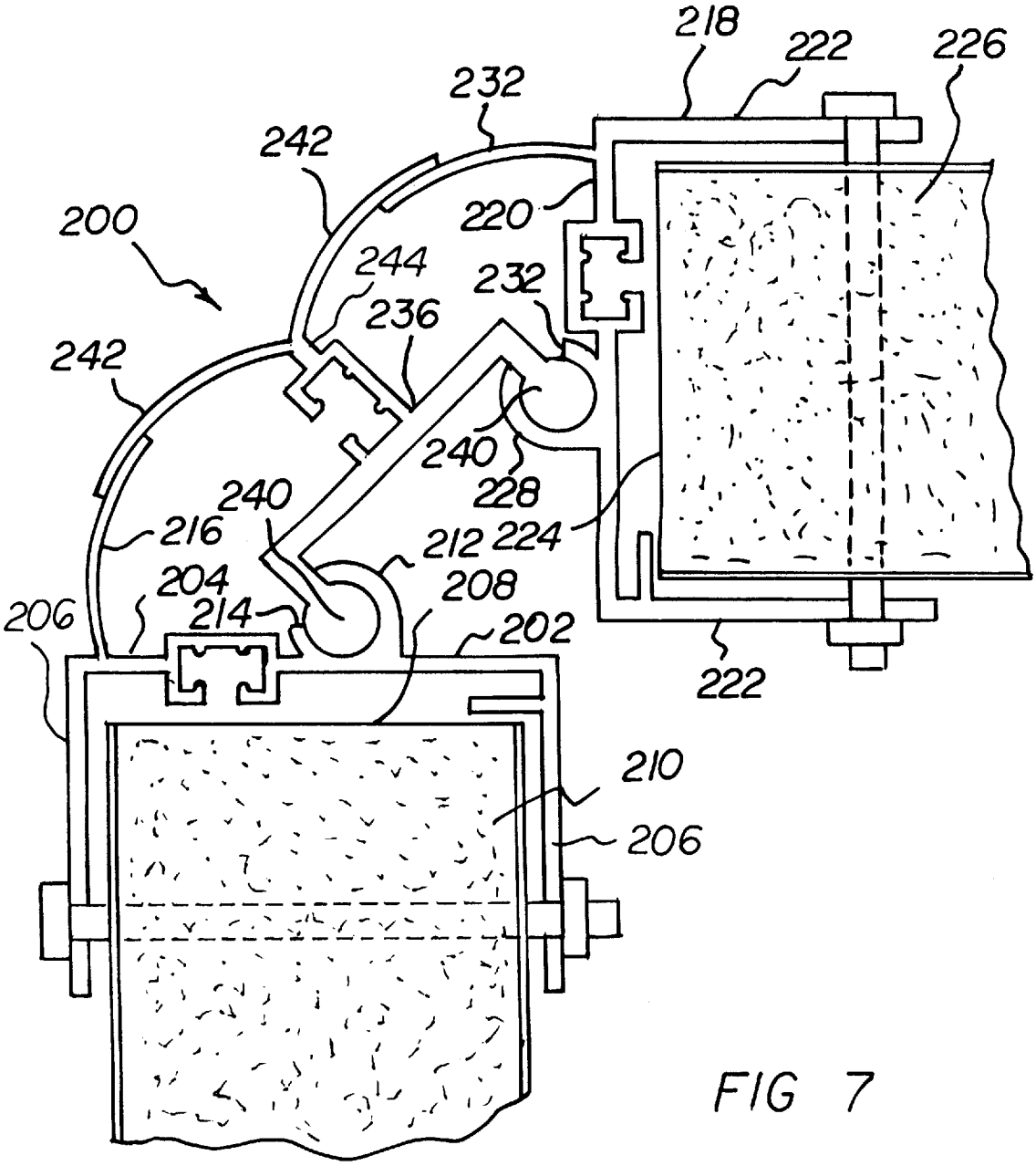
FIG. 7 is a cross-sectional view of a further embodiment of the adjustable coupling adapted for joining a sloped roof to a vertical wall connector.

As shown in FIG. 7, an additional embodiment relates to a new and improved adjustable connector assembly (200) for vertically coupling the adjacent lateral edges of construction wall panels comprising, in combination a first end component (202) having an elongated vertically disposed central plate (204) and opposed elongated parallel end plates (206) formed integrally with the central plate for receiving a lateral edge (208) of a vertically disposed construction wall panel (210). The central plate has a generally disposed circular C-shaped receptor (212) along the length thereof with an opening (214) of about forty-five degrees and an arcuate plate (216) adjacent to the exterior edge of the central plate. The arcuate plate has a center of curvature coextensive with the receptor. A second end component (218) has a vertically disposed plate (220) and opposed parallel face plates (222) formed integrally therewith for receiving the edge (224) of a construction panel (226). The face plate has a generally disposed C-shaped receptor (228) with an opening (230) of about forty-five degrees and an arcuate plate (232) adjacent to the exterior edge thereof. An intermediate extruded plate (236) in a generally H-shaped configuration has planar interior legs with inwardly extending projections (240) at their ends in a generally cylindrical configuration received within the receptors of the first and second end components and having exterior arcuate legs (242) extending in opposite directions from the center of curvature coextensive with the projections and receptors of the first and second members and having an intermediate coupling member (244) extending perpendicular between the centers of the first legs and second legs.

Figure 8:
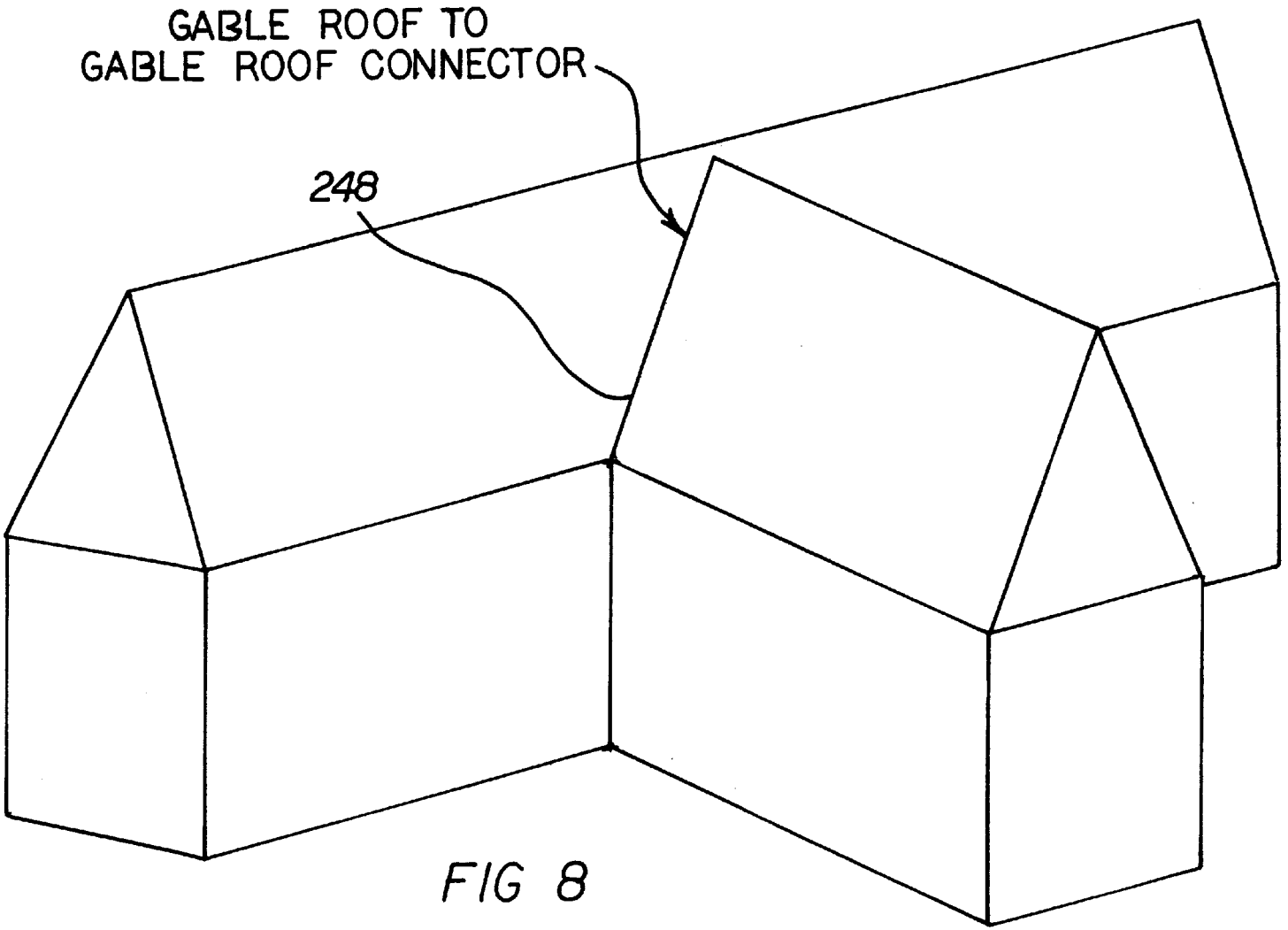
FIG. 8 is a perspective illustration of a gable roof to gable roof connector employing the connector of FIG. 7.

As shown in FIG. 8, an adjustable coupling device adaptable for joining a sloped roof to a vertical wall connector, rather such relates to the coupling of a gable roof to another gable roof at a junction line (248) which extends the utility of the connector and, specifically, the system overall.

While the following description will seek to improve understanding of the invention by describing the various components and elements, it should be considered that certain apparatus may be sufficiently and adequately explained by the accompanying drawings, which are fully incorporated herein, and not require further description. All such apparatus should be considered as part of the specification of the invention for all purposes.

It should be noted that those configurations of the present invention which provide for fasteners to be passed through both sides of a frame and an enclosed structural panel utilize the practice of through-bolting. Such improves the ability of the frame to handle both positive and negative wind loads.

Further modification and variation can be made to the disclosed embodiments without departing from the subject and spirit of the invention as defined in the following claims. Such modifications and variations, as included within the scope of these claims, are meant to be considered part of the invention as described.

What is claimed is:

1. A new and improved adjustable connector assembly for vertically coupling the adjacent lateral edges of construction wall panels comprising, in combination:

a first end component having an elongated vertically disposed central plate and opposed elongated parallel end plates formed integrally with the central plate for receiving a lateral edge of a vertically disposed construction wall panel, the central plate having a midpoint equally spaced between the end plates and a generally disposed circular C-shaped receptor along the length thereof laterally offset from and adjacent to the midpoint and with an opening forming primary abutment surfaces circumferentially spaced at forty-five degrees and an arcuate plate adjacent to the exterior edge of the central plate, the arcuate plate having a center of curvature coextensive with the receptor;

a second end component having an elongated vertically disposed central plate and opposed elongated parallel end plates formed integrally with the central plate for receiving a lateral edge of a vertically disposed construction wall panel, the central plate having a midpoint equally spaced between the end plates and a generally disposed circular C-shaped receptor along the length thereof laterally offset from and adjacent to the midpoint and with an opening forming primary abutment surfaces circumferentially spaced at forty-five degrees and an arcuate plate adjacent to the exterior edge of the central plate, the arcuate plate having a center of curvature coextensive with the receptor; and an intermediate extruded plate in a generally H-shaped configuration having planar interior legs with inwardly extending projections at their ends in a generally cylindrical configuration received within the receptors of the first and second end components with secondary abutment surfaces adapted to selectively contact the primary abutment surfaces of the first and second end components for selectively varying the angle between the first and second end components and having exterior arcuate legs extending in opposite directions from the center of curvature coextensive with the projections and receptors of the first and second end components and having an intermediate coupling member extending perpendicular between the centers of the interior legs and exterior legs.

* * * * *